US006366750B1

(12) United States Patent
Swain

(10) Patent No.: US 6,366,750 B1
(45) Date of Patent: Apr. 2, 2002

(54) MANDREL FOR A PHOTORECEPTOR BELT FORMED OF A RIGID MACHINABLE FOAM MATERIAL

(75) Inventor: Eugene A. Swain, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/596,742

(22) Filed: Jun. 19, 2000

(51) Int. Cl.[7] ..... G03G 15/00
(52) U.S. Cl. ..... 399/116; 399/164
(58) Field of Search ..... 399/116, 117, 399/159, 165, 164; 101/415.1; 198/813

(56) References Cited

U.S. PATENT DOCUMENTS 4,601,963 A * 7/1986 Takahashi et al. ..... 430/69
5,440,981 A * 8/1995 Vrotacoe et al. ..... 101/217
5,666,600 A * 9/1997 Kamprath et al. ..... 399/165

FOREIGN PATENT DOCUMENTS

JP 1-24287 * 1/1989

* cited by examiner

*Primary Examiner*—Quana M. Grainger
(74) *Attorney, Agent, or Firm*—Perman & Green, LLP

(57) ABSTRACT

A "drelt" photoreceptor particularly for use in high speed production color printers employing a lightweight porous machinable mandrel made of a foam material as a means of mounting a flexible belt photoreceptor on a rigid and lightweight cylindrical base. This porous foam—like cylinder is provided with means to temporarily decrease its circumference in order to mount the flexible belt on it. The foam material can be any material that can be formed into a foam type solid structure and then machined to certain precision. Examples of such foam material include a metal foam, a polymer foam, a ceramic foam or a carbon foam.

12 Claims, 1 Drawing Sheet

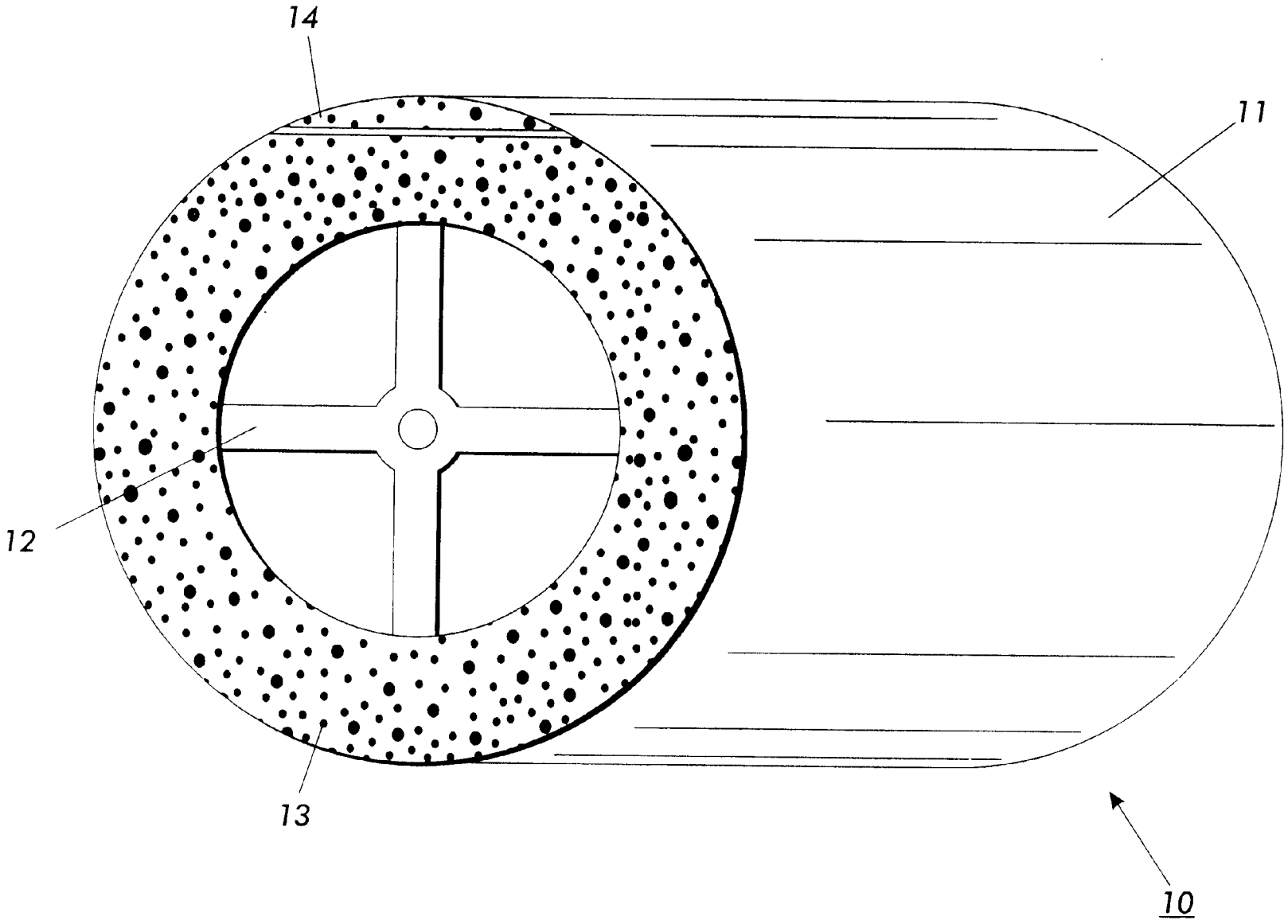
11
10
14
13
12

MANDREL FOR A PHOTORECEPTOR BELT FORMED OF A RIGID MACHINABLE FOAM MATERIAL

BACKGROUND OF THE INVENTION

1. Field of the Invention

This invention relates to photoreceptors for electrophotographic printing, and more particularly, this invention relates to a photoreceptor belt in combination with a cylindrical mandrel. Even more particularly, this invention relates to a photoreceptor belt removable attached to a lightweight cylindrical mandrel which is constructed of a machinable foam material.

The photoreceptor and cylindrical mandrel design of this invention is particularly well suited to replace the current belt or drum photoreceptor designs as presently used in electrophotographic printing machines. The present invention will help reduce various mechanical problems that are typically experienced in any electrophotographic apparatus that employs known combinations of a photoreceptor belt and cylindrical mandrel.

The photoreceptor and cylindrical mandrel design of this invention is particularly well suited for use in high speed production color printers, especially those printers that employ large drums which support the photoconductors. Large drums require large and heavy support structures for the drums.

2. Description of the Prior Art

In an electrophotographic mono-color printing machine an electrophotograpic process is employed in which a photoconductive member is charged to a substantially uniform potential. The charged portion of the photoconductive member is then exposed to a light reflected original document image. Exposure of the charged photoconductive member selectively dissipates the charge in the irradiated areas. This process records an electrostatic latent image on the photoconductive member corresponding to the informational areas contained within the original document being reproduced. After the electrostatic latent image is recorded on the photoconductive member, the latent image is developed by bringing it into contact with toner. The toner image on the photoconductive member is subsequently transferred to a copy sheet. The copy sheet is then heated to permanently affix the toner image to the sheet. Multicolor electrophotographic printing is substantially identical, although more complex than the mono-color printing process. In a multicolor process, after the photoconductor is cleaned of residual toner, the copying process occurs again.

Cyclic and tandem color copying processes dominate the art of color printing. In a cyclic multicolor printing process, successive latent images corresponding to different colors are recorded on the photoconductive member during each cycle. Accordingly, one photoconductive member is required in this type of machine. The photoconductive member is used repetitively for each color/cycle. Each single color electrostatic latent image is developed with toner of a color complementary thereto. This process is repeated a plurality of cycles for the difference colors in an image and the respective complementary color tone. Each single color toner image is transferred to the copy sheet and superimposed with the prior toner image. This creates a multilayered toner image on the copy sheet. Thereafter, the multilayered toner image is permanently affixed to the copy sheet creating a color copy. The primary attributes of a cyclic printing machine are its relatively low number of parts and its low cost. U.S. Pat. No. 4,583,991, herein incorporated by reference, describes a cyclic printing machine in which a sheet moves in a recirculated path and successive color toner images are transferred thereto.

A typical tandem printing machine uses multiple printing engines to transfer, in one cycle, different colored tone images directly to a sheet or to an intermediate surface for subsequent transfer to the sheet. The fast printing rate is the primary advantage of a tandem machine since all colors are printed in one cycle. However, the complex equipment of a tandem machine leads to a higher total cost.

U.S. Pat. Nos. 4,796,050 and 4,803,518, herein incorporated by reference, disclose tandem printing machines having a plurality of photoconductive drums arranged such that color separated light images of an original document are recorded thereon as electrostatic latent images. The latent images are developed into visible color images. A conveyor advances a sheet past each photoconductive drum. Visible color images are transferred from each photoconductive drum to the sheet and then fixed to the sheet.

Both cyclic and tandem printing machines can use drum or belt type photoreceptors. Disadvantages are encountered in the use of photoconductive belts because especially high speed production color printers require multiple large photoreceptors. These large size photoreceptors can range in size from four inches to fifteen inches in diameter and up to twenty-seven inches long. The substrate (mandrels) which support these photoreceptor belts are usually formed of aluminum tubes that are very heavy and quite expensive to produce. An available alternative to this type of substrate is a thin metal or plastic cylinder which slips over a core cylinder i.e., a (Drelt). The core cylinder can either be a part of the machine or a part of the photoconductor. In any case, this core is also usually very heavy. In the case of the core being part of the machine, these heavy cylinders must be rotated, and continually started and stopped. Due to their large diameter, this creates mechanical problems due to the momentum and inertia properties of the heavy core. Additional horsepower is required to drive these cylinders, and additional braking and control mechanisms are required for stopping or changing speed of the photoreceptor. In the case where the core is a part of the photoconductor, the weight is also a concern since this assembly must be constantly handled by technical representatives, and also shipped to various locations.

Accordingly, it is a primary object of this invention to provide a new and improved mounting apparatus (mandrel) for a photoreceptor which avoids all of the disadvantages outlined above. The new and improved mounting apparatus for a photoreceptor in accordance with the features of this invention is made of a very lightweight material that can also be precision machined; has particular use when mounting a flexible belt photoreceptor on a rigid cylindrical base support, thereby forming a "drelt" photoreceptor for use in high speed production color printers; and provides a new and improved mandrel from which a photoreceptor can be easily removed and replaced. In addition to these advantages the present invention provides a mounting apparatus for a belt photoreceptor or a rigid thin walled cylinder which supports a photoconductive material, i.e. a drum.

SUMMARY OF THE INVENTION

To achieve the advantages in accordance with the purpose of the present invention, as embodied and broadly described herein, the photoreceptor apparatus of this invention comprises a cylindrical mandrel having a photoreceptor belt attached thereto. Attached as used herein means the photoreceptor belt is substantially fixed in a place on the full circumference of the mandrel at the longitudinal surface by preferably an interference fit or other known method. Preferably, the means for attaching the belt to the mandrel comprises a retractable segment mechanism that is isolated against the photoreceptor belt to hold the photoreceptor belt in place. Preferably, the photoreceptor belt is a multilayered continuous belt. The photoreceptor apparatus in accordance with the present invention comprises a photoreceptor belt in combination with a cylindrically shaped mandrel to which the photoreceptor belt is adapted to be mounted, the mandrel or support for the photoreceptor being made of a machinable foam material.

An electrophotographic imaging process in accordance with the features of the present invention comprises charging a photoconductive member to a substantially uniform potential, said photoconductive member comprising a photoreceptor belt attached to a cylindrically shaped mandrel, the mandrel comprising a machinable foam material; exposing the charged photoconductive member to a light reflective image to dissipate portions of the charge; transferring toner to the charge; and transferring the toner to a copy sheet.

The photoreceptor used with the present invention is utilizable as a replacement for previously known photoreceptor drums in printing machines, for example U.S. Pat. No. 5,121,171 herein incorporated by reference.

The photoreceptor belt in the current invention can be any type. U.S. Pat. No. 4,265,990, herein incorporated by reference describes various acceptable belt photoreceptors.

BRIEF DESCRIPTION OF THE DRAWINGS

The accompanying drawing, which is incorporated in and constitutes a part of the specification illustrates one embodiment of the invention and, together with the description, serves to explain the principles of the present invention.

The FIGURE is an cross sectional perspective view of a belt photoreceptor mounted on a mandrel with a retractable segment mechanism all in accordance with the features of the present invention.

DETAILED DESCRIPTION OF THE INVENTION

Reference will now be made in detail to the present preferred embodiment of the invention, an example of which is illustrated in the accompanying drawing.

While the invention will be described in connection with a preferred embodiment, it will be understood that it is not intended to limit the invention to that embodiment. On the contrary, it is intended to cover all alternatives, modifications and equivalents as may be included within the spirit and scope of the invention defined by the appended claims.

Referring now to the drawing and the single FIGURE, a cylindrical mandrel 10 is shown having a surface 11 about which photoreceptor belt can be snugly mounted. The specific embodiment illustrated in the FIGURE shows a mandrel mount 12 around which is a cylindrical mandrel 13. Mandrel 13 includes a retractable segment mechanism 14 which is the means to temporarily decrease the circumference of cylindrical mandrel 13 in order to easily mount the photoreceptor belt 11 onto mandrel 13. Typically, copiers or printers or other types of reprographic machines, such as xerographic machines are designed with photoreceptors in one of two alternative geometries; drum or belt module. Belt modules provide distinct advantages in the interface flexibility, amount of surface (pitches) feasible, and the consumable cost of the belt itself. Drums provide improved motion quality, reduced machine cost, and a seamless photoreceptor. However, manufacturing capabilities favor belts. Some of the key benefits of the belt and the drum may be captured by mounting a belt in a xerographic machine such that it operates like a drum. The combination of a belt with a drum in accordance with the present invention will be referred to herein as DRELT (Drum bELT). A challenge involved in implementing such a system includes avoiding structures which are quite heavy and very expensive. This becomes a particularly critical issue as the xerographic machines become bigger and faster in speed of operation.

In accordance with the features of the present invention the mandrel structure can be as shown in the FIGURE (i.e. a mandrel mount 12 around which is a mandrel 13) or the mandrel can be a cylindrical solid mandrel eliminating the need for the mandrel mount 12. The critical feature in accordance with the present invention is that the mandrel 13 is formed of a lightweight foam material. This use of a foam material will provide a medium to allow for precision machining of the cylindrical structure which is needed while at the same time avoiding various mechanical problems due to the mass, momentum and deflection of a heavy cylinder type mandrel formed of a solid material (e.g. aluminum, iron, etc.) that is started and stopped in a xerographic copier environment as compared to a lightweight cylinder material. When heavy cylinders are used additional horsepower is required to drive these cylinders and additional braking and controls are required for stopping the xerographic apparatus or changing speed. In accordance with the present invention, the foam core (whatever its specific cylindrical structure) can be any lightweight structural foam material which can be precision machined.

The foam type structural materials have the combined attributes of high strength, good to excellent dimensional stability properties, good to excellent machineability and lower densities. Examples of such structural foam materials include a metal foam such as aluminum, steel or brass foam; a polymer foam material such as nylon, polystyrene polyester or a polycarbonate material all of which will form rigid, strong and lightweight foam structures; a carbon foam; or a ceramic foam. While these specific examples have been given it should be understood that the support for the photoconderator (the mandrel structure) in accordance with the present invention can be constructed of any structural material that can be made into a foam material which has the combined properties as described herein.

As stated above the core material for mounting the drelt is made from a lightweight (i.e. low density) foam material preferably in the density range of about 0.2 gm/cc to about 2.0 gm/cc. The density of about 0.25 gm/cc to about 0.5 gm/cc is preferred. In the case of a metallic foam material such as, for example aluminum foam, a preferred density is about 0.25 gm/cc or 0.044.11/cubic in. This compares to a density of 2.7 gm/cc for solid aluminum alloy. The aluminum form material is commercially available from ERG Technology and Aerospace Corporation. Aluminum, carbon and ceramic foam materials are also available from Energy Research and Generation, Inc. The core (or support or mandrel) could be of many different configurations depending on the design of the xerographic apparatus. The core can be as specifically shown in the FIGURE or it could be solid or in the form of a cylinder, with flanges or any other complex cylindrical shape. Whatever its configuration, it will form a light weight support for a thin shell with a photoconductive coating.

The core mandrel 12 in accordance with the features of this invention can be made mechanically expandable so that the photoreceptor can be easily assembled in the field. The FIGURE shows that the core 13 includes a retractable segment mechanism 14. The specific retractable segment mechanism employed in the present invention can be any of various prior art retractable segment mechanisms that are known. For example any of the retractable segment mechanisms disclosed in U.S. Pat. No. 5,666,600, herein incorporated by reference, can be used.

It should now be understood that a DRELT system has been provided and, in accordance with the features of the present invention, includes a cylindrically shaped support structure (i.e. mandrel) on which a photoreceptor belt is adapted to be mounted, the support structure comprising a structural and machinable foam material that fully satisfies the objects, aims and advantages set forth above.

What is claimed is:

1. A photoreceptor apparatus, comprising:

a photoreceptor belt; and a mandrel in the forum of an open cylinder structure on which the photoreceptor belt is adapted to be mounted, the mandrel comprising a rigid, lightweight and machinable foam material.

2. A photoreceptor apparatus of claim 1 wherein said belt is a flexible belt.

3. A photoreceptor apparatus of claim 1 wherein the density of said metallic foam material is in the range of about 0.2 gm/cc to about 2.0 gm/cc.

4. A photoreceptor apparatus of claim 1 wherein the density of said metallic foam material is in the range of about 0.25 gm/cc to about 0.5 gm/cc.

5. A photoreceptor apparatus of claim 1 wherein said foam material is a metal foam.

6. A photoreceptor apparatus of claim 5 wherein said metallic foam material is an aluminum based foam material.

7. A photoreceptor apparatus of claim 1 wherein said form material is a polymer foam.

8. A photoreceptor apparatus of claim 1 wherein said foam material is a carbon foam.

9. A photoreceptor apparatus of claim 1 wherein said foam material is a ceramic form.

10. An apparatus that facilitates the mounting and dismounting of a photoreceptor belt with respect to a support member for said belt, comprising:

a photoreceptor belt; and a cylindrically shaped mandrel onto which said photoreceptor belt is adapted to be mounted and dismounted, said mandrel including a retractable segment which enables said belt to be mounted and dismounted the improvement comprising wherein said mandrel comprises a lightweight machinable foam material.

11. An apparatus of claim 10 wherein said foam material is a metal foam.

12. A photoreceptor apparatus, comprising:

a photoreceptor belt; and a cylindrically shaped mandrel on which the photoreceptor belt is adapted to be mounted, the mandrel comprising a rigid, lightweight and machinable foam material, the mandrel including a retractable segment adapted to easily permit the photoreceptor belt to be positioned on the mandrel.

* * * * *